US008262545B1

(12) United States Patent
Beber et al.

(10) Patent No.: US 8,262,545 B1
(45) Date of Patent: Sep. 11, 2012

(54) WEIGHTED ATHLETIC TRAINING VEST

(76) Inventors: Richard A. Beber, Newport Beach, CA (US); Cheryl A. Ward, Newport Beach, CA (US)

( * ) Notice: Subject to any disclaimer, the term of this patent is extended or adjusted under 35 U.S.C. 154(b) by 0 days.

(21) Appl. No.: 13/200,952

(22) Filed: Oct. 4, 2011

Related U.S. Application Data

(60) Provisional application No. 61/571,284, filed on Jun. 23, 2011.

(51) Int. Cl.

| | |
|---|---|
| ***A63B 21/065*** | (2006.01) |
| ***A41D 1/04*** | (2006.01) |
| *A41F 15/00* | (2006.01) |
| *A41D 13/00* | (2006.01) |

(52) U.S. Cl. ..... 482/105; 482/14; 482/74; 482/93; 2/102; 224/264

(58) Field of Classification Search ..... 482/14, 482/15, 19, 74, 92, 93, 105; 2/102, 464, 2/465, 467; 473/438, 450, 458, 464; 224/648, 224/264; D21/683

See application file for complete search history.

(56) References Cited

U.S. PATENT DOCUMENTS

| | | | | | |
|---|---|---|---|---|---|
| 3,997,982 | A | * | 12/1976 | Holland | 434/260 |
| 4,658,442 | A | * | 4/1987 | Tomlinson et al. | 2/94 |
| 4,976,388 | A | * | 12/1990 | Coontz | 224/264 |
| 5,067,484 | A | * | 11/1991 | Hiemstra-Paez | 602/19 |
| 5,143,266 | A | * | 9/1992 | Heckerman et al. | 224/150 |
| 5,411,194 | A | * | 5/1995 | Nagasawa et al. | 224/254 |
| 6,081,924 | A | * | 7/2000 | Ott | 2/102 |
| D440,741 | S | * | 4/2001 | Veira | D2/737 |
| 6,209,135 | B1 | * | 4/2001 | Irvin | 2/102 |
| 6,256,791 | B1 | * | 7/2001 | Callahan | 2/102 |
| 6,286,146 | B1 | * | 9/2001 | Rocker | 2/94 |
| 6,375,053 | B1 | * | 4/2002 | Cecchinel | 224/267 |
| 6,554,752 | B2 | * | 4/2003 | Cook | 482/105 |
| 6,671,887 | B1 | * | 1/2004 | Eligan et al. | 2/228 |
| 6,834,396 | B2 | * | 12/2004 | Franco-Sion | 2/102 |
| D657,832 | S | * | 4/2012 | Beber et al. | D21/683 |

* cited by examiner

*Primary Examiner* — Loan Thanh
*Assistant Examiner* — Victor K Hwang
(74) *Attorney, Agent, or Firm* — Roy A. Ekstrand

(57) ABSTRACT

A weighted vest includes a pair of mirror image front panels joined to a back panel to form a sleeveless weight supporting vest. A plurality of pliable easily conformed weight packets are secured within the vest interior by fabric attachment pads together with a combination of elastic bands and belts. The vest provides weight distribution particularly suited to activities of substantial acceleration such as sprint starting, American football or the like. A porous liner and mesh outer layer over certain areas of the vest allow heat to be vented from the vest interior. A pair of variable spring rate expansion joints are coupled between the front panels and the back panel passing over the shoulder, neck and collar bone region of the athlete's body to provide reduction of localized stress upon the athlete.

20 Claims, 9 Drawing Sheets

WEIGHTED ATHLETIC TRAINING VEST

CROSS-REFERENCE TO RELATED APPLICATIONS

This application claims the benefit of and priority under 35 USC119(e) of U.S. Provisional Patent Application No. 61/571,284 entitled ATHLETIC TRAINING VEST filed Jun. 23, 2011 in the names of Richard A. Beber and Cheryl A. Ward, the discloser of which is incorporated herein by reference.

FIELD OF THE INVENTION

This invention relates generally to athletic training apparatus and particularly to weighted vest utilized in improving the performance of sprinters and other athletes seeking maximum starting and acceleration capabilities.

BACKGROUND OF THE INVENTION

In many track and field events such as sprinting, athletes participating as sprinters assuming a starting position often with the aid of a pair of embedded starting blocks. The starting stance assumed by the sprinter is characterized by flexed knees with feet against the off-set starting blocks, raised hips and lowered shoulders and head. The arms extend downwardly with the hands placed upon the ground supporting much of the sprinters weight. A starting command sequence is initiated during which the sprinters raise their hips and lean forward. The starting sequence terminates in a starting gun in response to which the sprinter drives forward and the upper body moves upwardly and forwardly while the leg drive is initiated. Ideally, the start is "explosive" rapidly accelerating the sprinter forward.

In American football, a similar starting stance is assumed by some of the players particularly those on the offense. In some instances, only one hand is placed upon the ground to support the player's weight. However, the mechanics of the explosive start and acceleration are much the same as those exercised by a sprinter. Effective starting skills for sprinters and other athletes are a matter of timing, reflexes, mechanics, techniques and power. For the most part, timing, reflexes, mechanics and techniques may be enhanced by instruction, training and practice. The increase of power beyond a certain level of performance however remains difficult to achieve solely through repetitive practice and training. In essence, power increase beyond a certain level of performance requires some type of muscle-building and muscle-strengthening which can, for the most part, only be achieved by some type or resistance training or weight training.

As mentioned above, the need for explosive power and acceleration is not limited to sprinters but is desirable for other athletes such as American football players. It will be understood that other athletic activities require some level of explosive acceleration for optimum performance. Thus, the training principles and difficulties described and discussed therein as applied primarily to sprinters will be understood to be equally applicable to the endeavors of a variety of other types of athletes. For many years, resistance and weight training were not embraced by most instructors and trainers in sprinting events. However, as training and sprinting techniques continued to developed and as the sport became ever more competitive, renewed attention was directed toward resistance and weight training for the sprinter and other similarly active athletes. Much of this attention focused upon what is best described as resistance training machines.

One apparatus known in the art as the AUSTIN LEG DRIVE MACHINE has become somewhat successful for training sprinters and other athletes such as American football players or the like to improve explosive starting capability and acceleration.

The Austin Leg Drive Machine is a relatively large apparatus comprised of an upwardly inclined ramp having a pair of sidewalls on each side of the ramp. A shuttle with hand grips and shoulder braces is movable along the side rails. A pair of weight arms are pivotally secured to the far end of the side rails and extend rearwardly above the side rails. A pair of wheeled trolleys joined to the shuttle are movable upon the side rails beneath the weight arms. Adjustable weights are supported on the movable end of the weight arms. The side rails and weight arms are configured such that forward movement of the trolleys under the influence of the shuttle raises the free ends of the weight arms against the resisting weights. In operation, the athlete assumes a starting stance in front of the shuttle against the shoulder braces. The athlete then drives forwardly up the ramp against the shuttle accelerating as fast as possible. As the shuttle is driven on the side rails and the athlete drives up the rail, the weighted arms are pivoted raising the weights.

While such types of training machines proven effective in enhancing the starting power and acceleration of athletes such as sprinters and football players, they are also prohibitively expensive, large and lack portability. As a result, such types of training machines are for the most part widely available.

Faced with the practical limitations of training machines to improve starting and acceleration capability in athletes such as sprinters and football players, practitioners in the art have endeavored to develop various weight training garments. The basic concepts of weight training is well known in that it has been found that working against extra weight during training builds additional muscle and strengthens existing muscle. As would be expected, the application of weight training to the starting power and skill of sprinting athletes has been the subject of designs which have varied substantially. However, the basic objective is relatively simple. Typically a garment, usually a sleeveless vest, is worn by the athlete during training activities. The vest supports a plurality of weights distributed about the vest. As the athlete trains, the weighted vest provides resistance to movement such as starting and acceleration which it is hoped will increase muscle power and strength.

The variety of weighted training vests provided by practitioners in the art is virtually endless. For example, U.S. Pat. No. 6,557,176B2 issued to Franco-Sion sets forth a WEIGHT VEST having a shell constructed of a plurality of panels defining front and back portions. The front of the vest includes first and second sides which are selectively connectable utilizing a zipper and one or more straps. The shell includes arm opening and supports a plurality of weight pockets distributed within the vest interior. The weights are generally distributed on either side of the arm holes upon the front and rear of the garment and are supported in a band about the hip portion of the garment.

U.S. Pat. No. 6,834,396B2 issued to Franco-Sion sets forth a WEIGHT VEST substantially identical to the above-identified U.S. Pat. No. 6,557,176B2. Again, the weight pockets within the vest are distributed on either side of the arm openings and in a banded arrangement about the hip portions of the vest.

U.S. Pat. No. 6,209,135B1 issued to Irvin sets forth an EXERCISE VEST WITH PLIABLE WEIGHTS having a vest comprised of right and left front panels connected to a back panel by elastic sides and webbing straps on top. A plurality of weights are removably but snuggly received in elastic pockets arranged on the front and back panels of the vest. The weights are retained by elastic straps extending over the retaining pockets. The front and back panels of the vest are preferably constructed of an elastic expandable material including expanding fabric and rubber padding sheets there between.

U.S. Pat. No. 4,268,917 issued to Massey sets forth a VARIABLY WEIGHTED VEST having a plurality of pockets for reception of commonly availably material such as sand, pebbles, small stones or coins. The pockets are deep and elongated and are sized to receive a significant amount of weighted materials. The elongated tubular pockets are formed to minimize lateral shifting of the weight. The vest is relatively loose fitting to permit maximum comfort and body movement.

U.S. Pat. No. 4,382,302 issued to Watson sets forth a WEIGHTED TRAINING VEST HAVING CONSTANT WEIGHT DISTRIBUTION which includes front and rear pliable panels adapted to fit the wearer's chest and back. A plurality of weights are adapted to be affixed to the panels selectively and individually in a predetermined pattern. The panels are sufficiently rigid to maintain the pattern of weight placement during running and other activities. The panels also have a resilient, slip-resistant interior surface to prevent relative movement between the panels and the wearer's skin.

U.S. Pat. No. 4,394,012 issue to Egbert et al sets forth a WEIGHTED EXERCISE VEST having a vest formed of overlapping front panels and a joined rear panel. The vest further supports a plurality of pockets which receive a corresponding plurality of weight capsules. The weight capsules are of a uniform size and shape and are sized to fit snuggly into the pockets. The weight and weight distribution of the vest is adjusted by inserting the desired number of weight capsules into the pockets.

U.S. Pat. No. 4,658,442 issued to Tomlinson et al sets forth a WEIGHT VEST having a back panel together with left and right front panels connected thereto. The panels are formed of a pliable material having a short length to fit above the waist of the user. Elastic panels join the front and back panels along their respective side edges. Pockets on the panels receive weights which are shaped to snuggly fit within the pockets. In an alternate embodiment, the vest accommodates pliable padded weights intended to inform to the user's body.

U.S. Pat. No. 5,002,270 issued to Shine sets forth an EXERCISE VEST having a body formed of front, back and side panels connected to define an internal cavity. The vest is adjustable such that the diameter of internal cavity may expand or contract to conform to the user. A plurality of pockets are attached to the body and weights are receivable within the pockets. The weight pockets are releaseably closable by flaps associated with each of the pockets.

U.S. Pat. No. 5,144,694 issued to Conrad Daoud et al sets forth EXERCISE APPAREL AND WEIGHT PACKETS including a vest, pants, spine strap, belt, wrist bands, ankle bands and weight packets. The vest and pants are each provided with structure for holding at least one weight packets. The weight packets include plural rows and plural columns of weight members adjacent a layer of padding inside of a cloth pouch.

U.S. Pat. No. 5,810,699 issued to Nadeau sets forth an EXERCISE VEST including lower and intermediate rows of pockets extending along the outside of its back and side sections. A weight is provided for each pocket. A padded lumbar support belt extends through aligned belt loops on the inside of the vest to cover the area between the lower row of pockets and the user's waist.

U.S. Pat. No. 6,081,924 issued to Ott sets forth a WEIGHTED TRAINING VEST capable of conforming to the body of the wearer. A top loaded vest is provided which extends over the wearer's thorax and terminates entirely above the wearer's abdomen to permit body movement and breathing. Stretchable shoulder harnesses or straps are utilized to support the vest upon the shoulder of the wearer. A pair of securement straps gird the wearer's chest to ensure that the weights and vest do not bounce or shift during exercise.

U.S. Pat. No. 7,490,361B1 issued to Floyd set forth a WEIGHTED EXERCISE VEST having a plurality of pockets for holding small items and standard free gym weights. Each pocket includes a pocket opening and a pocket flap for securely maintaining the items and weights within each pocket. The vest includes shoulder support pads for protecting the user's shoulders by cushioning the weight of a weight lifting equipment such as a barbell.

Examples of aesthetic designs for weighted vests are set forth in design patents Des. 390,338; Des. 340,794 and Des. 278,840. Despite the substantial efforts of practitioners in the art in providing the above-described prior art weighted training vests, practitioners have failed to provide an effective weight training vest suitable for sprinting and acceleration. In fact, the foregoing described prior art devices have been replete with problems and limitations. For example, in the above-described starting position of a sprinter, a critical problem arises in the weight distribution of the weights within the prior art training vests. It has been found that the prior art practice of providing weighted vests which position the weights in packets about the chest and back at a substantial distance from the abdomen is unacceptable for training in sprint starts and acceleration. It is believed that the use of weighted vests having weights thus distributed results in a difficulty of maintaining balance and proper starting techniques and mechanics by the participating athletes. This poor balance leads to degraded mechanics and even strain or injury by the sprinter or other participating athletes.

Other problems arise in the fabrication of prior art weighted vests which relate to the fabrications of the supporting vests themselves. Prior art vests are often overly restrictive in attempting to conform to the wearer's body. Thus, free movement of the athlete is often interfered with during activities typical of athletic training. In addition, such highly restrictive vests are also very uncomfortable for the athletes.

In addition, other problems arise which are caused by a failure to maintain and securely position the weights within the weighted vests. As a result, weights often tend to move or shift as the athlete participates in various training activities. In many instances, the prior art designers have attempted to control weight shifting and weight movement problems by utilizing highly restrictive belts or straps upon the vests. Such restrictive and generally unyielding belts or straps often exacerbate the freedom of movement problems for the athlete and in some instances even unduly restrict the athlete's ability to breathe which, of course, is vital to athletic training.

Further problems arise in prior art weighted vests in the nature of straps utilized which are often non-stretch unyielding members which when tightened upon the athletes body impose localized stress and strain on the athlete at various low sustaining body engagement areas. One of the most critical of the body engagement areas is the area corresponding to the athletes shoulder, neck and collar bone region. Typically, this portion of the athlete's body bares much of the load imposed upon the athlete's body by the weighted vests shoulder straps. Prior art attempts to meet this problem with padding have proven to be largely ineffective.

As a result, there arises a need in the art for improved weighted athletic training vests which overcome the problems and limitations of the prior art apparatus.

SUMMARY OF THE INVENTION

Accordingly, it is a general object of the present invention to provide improved apparatus for weight training which is particularly suited to the training needs of sprinters and other similarly acting athletes. It is a more particular object of the present invention to provide an improved weighted athletic training vest which may be comfortably and securely worn by the athlete and which permits largely unrestricted freedom of movement while supporting a plurality of conformable weights at opportune positions upon the athletes body. It is a still further object of the present invention to provide an improved weighted athletic training vest which allow sufficient freedom of movement and maintains sufficiently secured vest and weight position upon the athlete's body to permit use in additional activities beyond sprinting such as participation in contact or movement sports such as American football or the like. It is a still more particular object of the present invention to provide an improved weighted athletic training vest which minimizes the stress placed upon the athlete's body by the weight presence with specific attention to the neck, shoulder and collar bone areas of the athlete's body.

In accordance with the present invention, there is provided a weighted athlete training vest comprising: a back panel and a pair of generally mirror-image front panels joined to form an athletic vest having an abdomen-encircling vest portion; a plurality of weight packet receptacles within the abdomen-encircling vest portion; a plurality of weight packets each removably receivable within the weight packet receptacles and each having a pliable envelope defining a plurality of compartments filled with a particulate weight material to form a pliable weight packet easily conformed to the body of an athlete wearing the vest; a porous mesh portion formed on the abdomen-encircling vest portion providing ventilation of the vest; and a pair of belts supported on the abdomen-encircling vest portion each having joinable buckles for drawing the belts tightly upon the abdomen-encircling vest portion to further secure the weight packets.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS OF THE INVENTION

Figure 1:
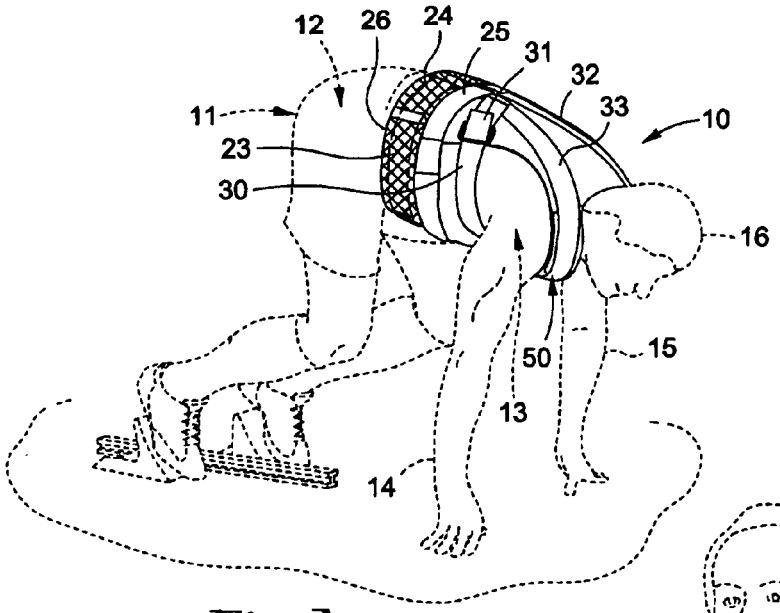
FIG. 1 sets forth a perspective view of a typical sprinter in a starting stance wearing a weighted athletic training device constructed in accordance with the present invention.

FIG. 1 sets forth a perspective view of an illustrative sprinter generally referenced by numeral 11 and shown in a dashed line representation wearing a weight athletic training vest constructed in accordance with the present invention and generally referenced by numeral 10. The position assumed by sprinter 11 is the typical starting stance of a sprinter in which the feet are received against starting blocks and the body is leaned forwardly with hips 12 raised above shoulders 13. Further, head 16 is directed downwardly and arms 14 and 15 of sprinter 11 extend downwardly to place the sprinter's hands upon the ground in a partial weight support. The position shown for sprinter 11 illustrates the critical weight balance needs which the present invention weighted athletic training vest is specifically created and designed to meet. Weighted vest 10 is fabricated of strong pliable textile material and includes a back panel 20 together with a pair of front panels 21 and 22 (front panel 21 and 22 better seen in FIG. 2). In further accordance with the present invention, weighted vest 10 includes a mesh area 23 encircling vest 10 and extending downwardly to a bottom edge 26. In further accordance with the present invention, weighted vest 10 includes a side belt 30 extending between back panel 20 and front panel 22 (seen in FIG. 2). Side belt 30 is secured by a conventional buckle 31. As is also better seen in FIG. 2, a corresponding second side belt 36 is secured between front panel 21 and back panel 20. Vest 10 further includes a pair of abdomen encircling belts 24 and 25. Back panel 20 is reinforced with a pair of vertical straps 32 and 33 extending upwardly and outwardly on back panel 20.

In accordance with an important aspect of the present invention, weighted vest 10 further includes a pair of variable rate elastic expansion joints 50 and 60 (joint 60 seen in FIG. 2) which pass over the shoulders of sprinter 11. The structures of expansion joints 50 and 60 is set forth below in FIGS. 5A-5C in greater detail. However, suffice it to note here that in accordance with an important aspect of the present invention, expansion joints 50 and 60 elastically couple back panel 20 to front panels 21 and 22 in a variable spring rate coupling which reduces the stress imposed upon the shoulders of sprinter 11 as the sprinter accelerates such as leaving the starting stance shown in FIG. 1. In accordance with a further important aspect of the present invention, which is set forth and described below in greater detail, the various weight packets (seen in FIGS. 9 through 11) supported within weighted vest 10 are generally distributed beneath belts 24 and 25 to maintain the positions of the weight packets at the desired location low on the sprinter's back and on the abdomen. This is critical to maintaining the desired mechanics of sprinter start as the sprinter explodes from the stance shown in FIG. 1.

Figure 2:
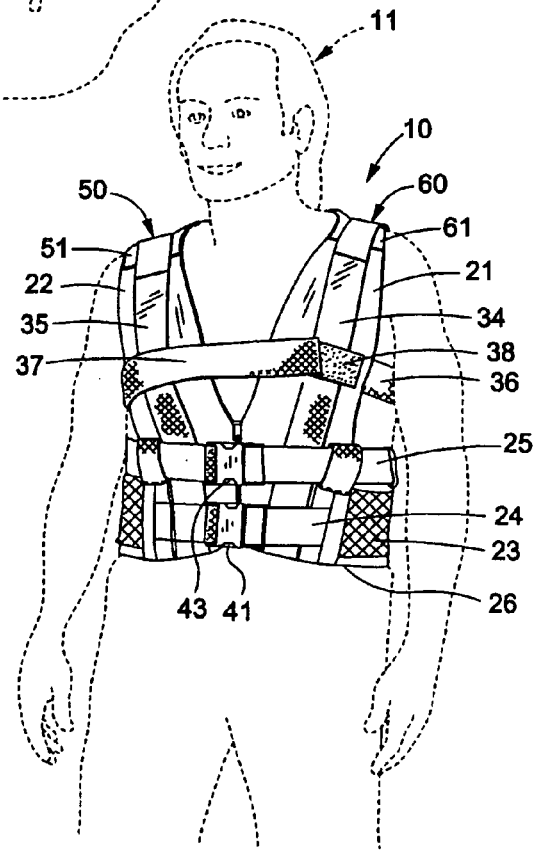
FIG. 2 sets forth a front view of an athlete wearing the present invention weighted athletic training vest.

FIG. 2 sets forth a front view of sprinter 11 wearing weighted vest 10. As described above, weighted vest 10 is formed of a pliable strong fabric and defines front panels 21 and 22 together with a back panel 20 (seen in FIG. 1). As is also described above, weighted vest 10 includes a mesh portion 23 extending upwardly from bottom edge 26 and generally encircling the lower portion of weighted vest 10. As is also described above, a pair of belts 24 and 25 encircle the lower portion of weighted vest 10. Belt 24 passes beneath mesh portion 23 and is joined at the front of weighted vest 10 by a conventional buckle 41. Similarly, belt 25 encircles the mid portion of sprinter 11 and is supported by a plurality of belt loops. Belt 25 is secured at the front portion of weighted vest 10 by a conventional buckle 43. A conventional zipper 44 joins the edges of front panels 21 and 22. A pair of vertical support straps 34 and 35 are joined to front panels 21 and 22 respectively and extend upwardly from bottom edge 26 to expansion joints 60 and 50 respectively. As mentioned above, and in accordance with an important aspect of the present invention, the portion of weighted vest 10 passing over the shoulders and neck and collar bone region of sprinter 11 includes a pair of variable rate expansion joints 50 and 60. Once again, the structure of expansion joints 50 and 60 is set forth below in FIGS. 5A-5C in greater detail. Weighted vest 10 further includes a side belt 36 joined to front panel 21. A chest belt 37 extends across front panels 21 and 22 of weighted vest 10 and is joined to a hook and loop fabric attachment pad 38 secured to front panel 21. This attachment is facilitated by a cooperating hook and loop fabric attachment pad 39 supported on the underside of chest belt 37.

Figure 3:
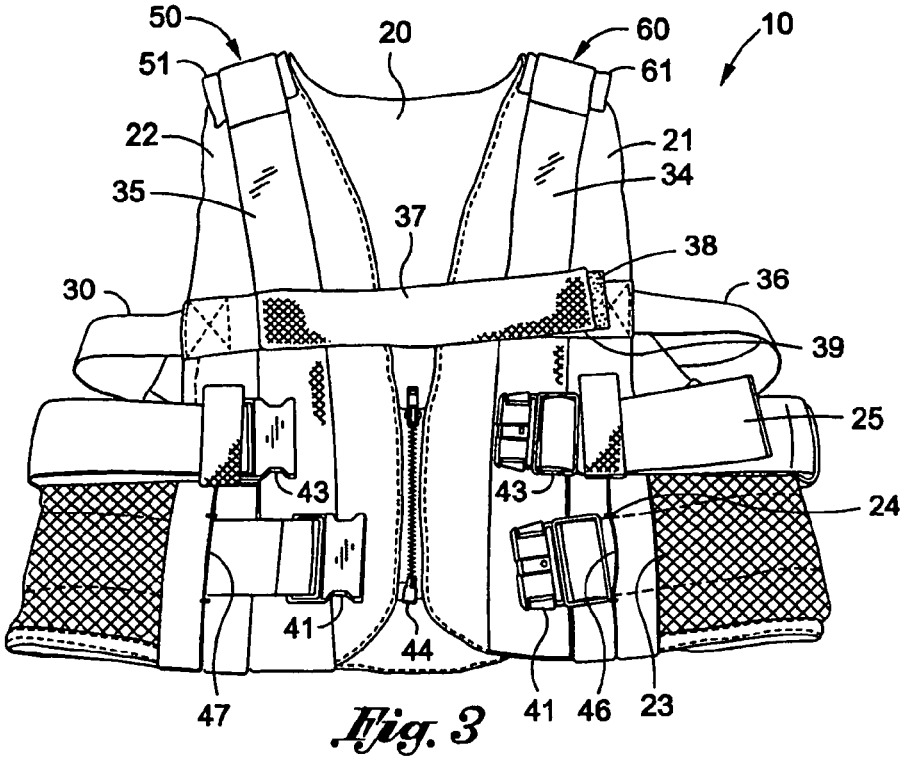
FIG. 3 sets forth a front view of the present invention weighted athletic training vest having the securement belts open.

FIG. 3 sets forth a front view of weighted athletic training vest 10 having belts 24 and 25 in an open unbuckled relaxed configuration. As described above, weighted vest 10 is fabricated of a strong pliable fabric material formed into a pair of front panels 21 and 22 which are essentially mirror images of each other and both of which are joined to a back panel 20. Front panel 21 and 22 support a pair of vertical support straps 34 and 35 which are joined to front panels 21 and 22 by conventional fabric attachment such as heavy duty sewing or the like. Vertical support straps 34 and 35 extend upwardly upon front panels 21 and 22 from bottom edge 26 of weighted vest 10. The interior edges of front panel 21 and 22 are joined by a conventional zipper attachment 44. A pair of side belts 30 and 36 are joined to back panel 20 and front panels 22 and 21 respectively. Front panel 21 further supports a hook and loop fabric attachment pad 38 secured in general alignment with side belt 36. A chest belt 37 is joined to front panel 22 in approximate alignment with side belt 30 and extends across front panels 22 and 21. Chest belt 37 supports a hook and loop fabric attachment pad 39 on the undersurface of its loose end. Hook and loop fabric attachment pads 38 and 39 form a cooperating pad pair of the type such as are manufactured and distributed under the tradename Velcro. However, it will be apparent to those skilled in the art that a plurality of different types of hook and loop fabric attachment pairs may be used for pads 38 and 39.

Weighted vest 10 further includes a lower belt 24 having a buckle 41 shown in its unbuckled configuration. Weighted vest 10 further includes a belt 25 which includes a conventional buckle 43 shown in its open configuration. A mesh portion 23 is formed on the lower portion of vest 10 and extends generally upwardly from bottom edge 26. In accordance with an important aspect of the present invention, and in accordance with structure set forth below in greater detail in FIG. 5, a plurality of weight packets (seen in FIGS. 9 through 11) are securable beneath mesh area 23 and are captivated and held against the user's body by the cooperation of belts 24 and 25. Once again, it must be emphasized that this distribution of weight packets is extremely advantageous in maintaining proper weight distribution for effective training for sprinters and the like. In particular, this distribution of weight about the abdomen of the user allows the user to continue to maintain balance and exercise and practice proper starting mechanics and techniques while wearing the vest.

In further accordance with an important aspect of the present invention, front panels 21 and 22 are joined to back panel 20 by a pair of variable rate expansion joints 50 and 60. The detailed structure of expansion joints 50 and 60 is set forth below in FIGS. 5A-5C. However, suffice it to note here that the action of expansion joints 50 and 60 absorbs energy during user acceleration caused by the inertia of distributed weights supported within the lower portion of weighted vest 10. In essence, as the user accelerates, the inertia provided by weights distributed within weighted vest 10 causes vest 10 to pull downwardly upon the user's shoulder, neck and collar bone area. The cooperation of expansion joints 50 and 60 together with the supporting actions of belts 24 and 25 effective transfer the users forward acceleration to the supported weights without imposing undue stress upon any area of the users body.

Figure 4:
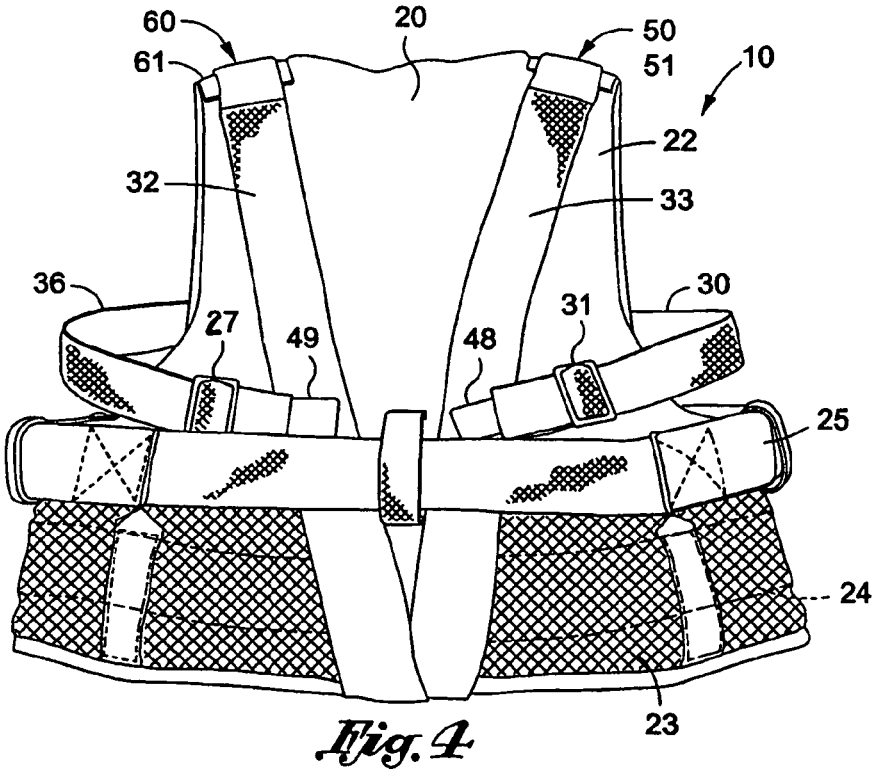
FIG. 4 sets forth a rear view of the present invention weighted athletic training vest.

FIG. 4 sets forth a rear view of weighted vest 10 in a relaxed configuration. As described above, weighted vest 10 includes a back panel 20 joined to a pair of front panels 21 and 22 (seen in FIG. 3). A pair of expansion joints 50 and 60 couple the upper portions of back panel 20 to front panels 22 and 21 respectively. Vest 10 further includes a pair of vertical support straps 32 and 33 which are secured to the outer surface of back panel 20 by conventional sewing attachment or the like. Vertical support straps 32 and 33 extend downwardly and inwardly from expansion joints 60 and 50 respectively to bottom edge 26. Weighted vest 10 further includes a mesh area 23 within which a belt 24 is supported. A second belt 25 encircles the outside of weighted vest 10 and is supported by conventional belt loops. Belts 24 and 25 are preferably formed of a three-piece construction each having a non-stretch portion, an elastic stretchable portion and a buckle. The elastic portion provides a tension force which aids in securing the weight packets against the wearer's body while also providing some give to aid breathing. Buckles 41 and 43 are preferably formed as quick release buckles such as those manufactured by Batz Corporation and shown in U.S. Pat. No. 6,792,654. The use of this quick release construction allows the user to quickly release the buckles upon completion of an exercise to aid in heavy breathing. A pair of side belts 30 and 36 extend from front panels 22 and 21 respectively to back panel 20 using conventional buckles 31 and 27 respectively. Side belts 30 and 36 include elastic end loops 48 and 49 respectively which allow side belts 30 and 36 to provide some give which is very important when the user has expended great effort and is breathing heavily. Elastic loops 48 and 49 also function to maintain an appropriate elastic force upon the weight packets under straps 30 and 36 during violent breathing or gasping by the user thereby holding the weight packets in place.

Figure 5:
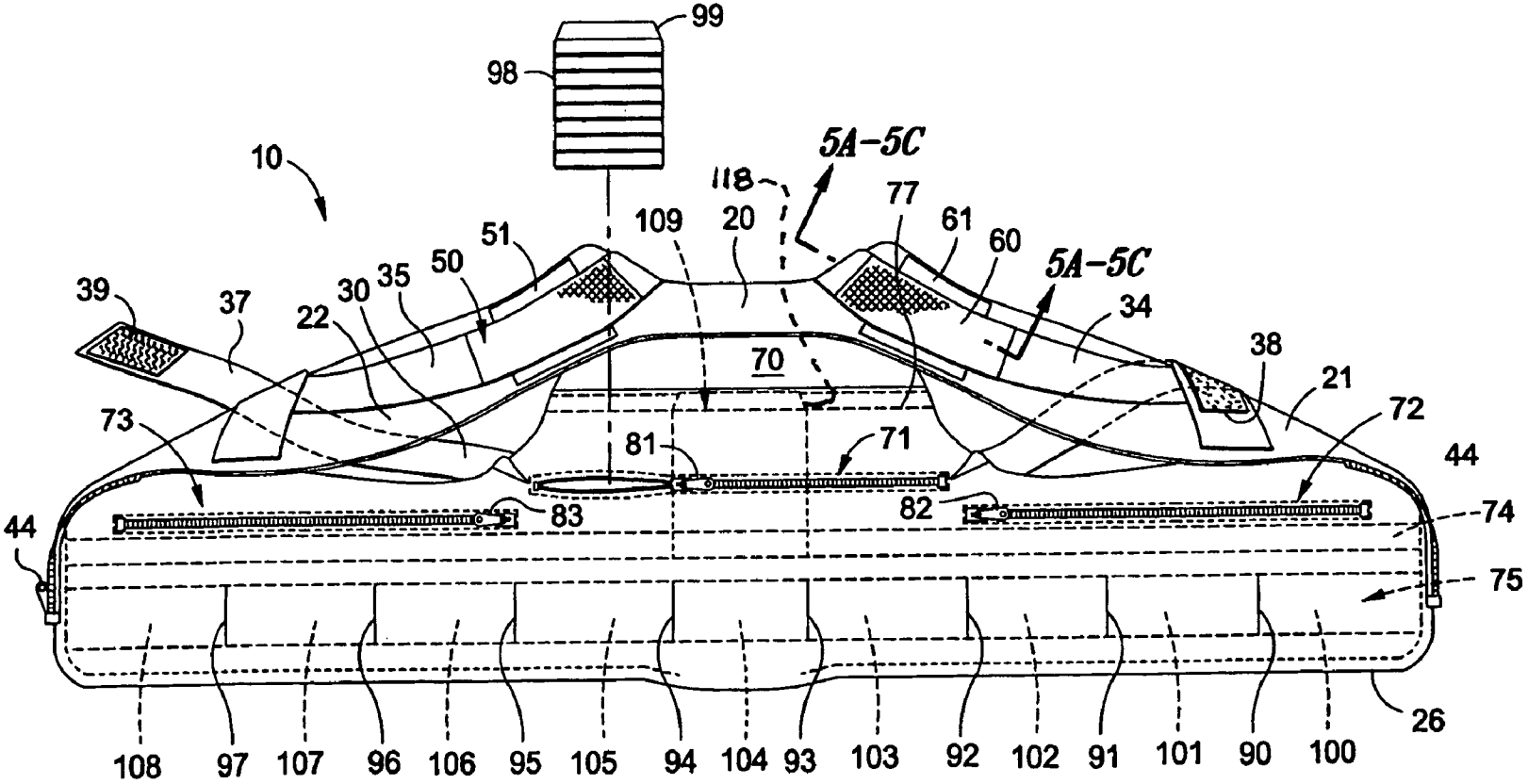
FIG. 5 sets forth a front view of the present invention weighted athletic training vest in an open flattened configuration.

FIG. 5 sets forth a front view of the present invention weighted athletic training vest in a fully opened generally flattened configuration. As described above, weighted vest 10 includes a pair of front panel 21 and 22 joined to a back panel 20. Front panel 21 includes a vertical support strap 34 and a hook and loop attachment pad 38. Vertical support strap 34 extends upwardly from hook and loop fabric attachment pad 38 to an expansion joint 60. Expansion joint 60 couples front panel 21 to back panel 20. Similarly, front panel 22 includes a vertical support strap 35 extending upwardly upon front panel 22 and is coupled to an expansion joint 50. In similar fashion to expansion joint 60, expansion joint 50 couples front panel 22 to back panel 20. Weighted vest 10 further includes a pair of side belts 36 and 30 which extend between back panel 20 and front panels 21 and 22 respectively. Vest 10 further includes a chest belt 37 having a hook and loop fabric attachment pad 39. As mentioned above, fabric attachment pads 38 and 39 are fabricated to provide cooperating hook and loop fabric attachment. Vest 10 further includes a bottom edge 26 and a zipper 44. The latter is operative to facilitate joining the adjacent edges of front panels 21 and 22 to provide closure of vest 10 about the user.

In further accordance with the present invention, weighted vest 10 includes a liner 70 preferably formed of a somewhat pervious fabric which facilitates air passage and ventilation when worn. Liner 70 extends about the entire interiors of front panels 21 and 22 and back panel 20. Liner 70 further defines a plurality of slots 71, 72 and 73. Slots 71, 72 and 73 are provided with zipper closures 81, 82 and 83 respectively. Zippers 81 through 83 are of conventional fabrication and provide either opening or closing of slots 81 through 83 as desired. Of importance with respect to the present invention is the access which slots 71 through 73 provide to the interior space between liner 70 and the interior surfaces of back panel 20 and front panels 21 and 22. Thus, as liner 70 overlies the inner surface of back panel 20 and front panels 21 and 22 a space is formed therebetween which, in accordance with the present invention, is used to support the desired arrangement of weight packets. A typical weight packet 98 is shown in relation to vest 10. The structure of weight packet 98 is set forth below in FIGS. 9 through 11. However, suffice to note here that in accordance with an important aspect of the present invention, the weight packets such as weight packets 98 utilized in the present invention weighted vest are formed of a pliable fabric generally planar envelope which is sewn to form a plurality of tubular spaces therein. The spaces within the tubular portions of the weight packet are filled with a particulate weight material such as finely sized lead shot or the like. Additionally, weight packets 98 is shown to include an attachment flap 99.

Returning to the structure of weighted vest 10, an elongated band of hook and loop attachment fabric 74 is supported beneath liner 70 and is secured to the inner surface of back panel 20 and front panels 21 and 22 using conventional attachment such as sewing or the like. An additional band of hook and loop attachment fabric 77 is also supported beneath liner 70 and is secured to the inner surface of back panel 20 at a vertical distance above attachment fabric 74 in panel 20. Attachment band 74 and 77 are preferably formed of a conventional hook and loop fabric attachment. Correspondingly, and as is better seen in FIGS. 9 through 11, attachment flap 99 of weighted packet 98 supports a hook and loop fabric attachment pad which is cooperative with attachment band 74. Weighted vest 10 further includes an elongated elastic band 75 positioned between liner 70 and the interior surface of back panel 20 and front panels 21 and 22. Elastic band 75 is preferably formed of a generally flat elastic member and is secured to the interior surface of liner 70 at a plurality of stitched lines 90 through 97. Stitch lines 90 through 97 preferably comprise conventional sewn stitching or other suitable attachment. Stitch lines 90 through 97 divide elastic band 75 into a plurality of weight packet receiving spaces 100 through 108. Spaces 100 through 108 form weight-retaining elastic band segments which are utilized in securing the position of weight packets within weighted vest 10. The detailed structure of weight attachment within weight retaining bands 100 through 108 is set forth below in FIG. 12 in greater detail. However, suffice it to note here that a weight packet is positioned at a selected location within weighted vest 10 by accessing the desired area through slots 71 through 73 after opening the corresponding zipper 81 through 83. In the example shown in FIG. 5, weight packet 98 is positioned in alignment for insertion through slot 71 and into weight-retaining band 105. Thus, with zipper 81 open a sufficient distance to allow weight packet 98 to pass through the corresponding portion of slot 71, weight 98 is moved beneath liner 70 to be inserted into the space formed between weight-retaining band 105 and the interior surface of liner 70. In its preferred fabrication, the space between stitch lines 94 and 95 produces a length of pliable elastic material forming weight-retaining band 105 which receives weight packet 98 in a tight fit. With weight 98 positioned within weight-retaining band 105, attachment flap 99 is secured to the underlying portion of attachment band 74 in the manner shown in FIG. 12.

In accordance with an important aspect of the present invention, it will be apparent to those skilled in the art that a plurality of weight packets such as weight packet 98 may be selectively positioned in some or all of weight-retaining bands 100 through 108. It will be further apparent to those skilled in the art that the selective position of weight packets in the locations of weight-retaining bands 100 through 108 positions the weight packets in an encirclement of the abdomen of the user. This has been found to be the optimum position for weight support in sprint start and acceleration training. It will be further apparent to those skilled in the art that substantial variation of the amount of weight to be utilized with weight vest 10 is achieved by simply choosing the total number of weight packets to be supported within the vest. Once the number of weight packets is determined, an even distribution of weight about the user's abdomen may be achieved by selecting the particular ones of weight-retaining bands 100 through 108. In certain training regimens, it may be desirable to concentrate weight at a particular area of the weight vest to further aid in the attainment of balance or training mechanics. For example, weights may be exclusively positioned in weight-retaining bands 100 through 102 and 106 through 108 if it is desired to position weight solely in the frontal abdomen area. Conversely, it may be desirable in certain training regimens to place weights solely in weight-retaining bands 103 through 105 in the event it is desired to concentrate weight upon the user's lower back. Further, and in accordance with a further advantage of the present invention, the elastic character of elastic band 75 allows weight-retaining bands 100 through 108 to stretch sufficiently to accommodate a second weight packet should the need arise. This provides further flexibility of use and further improves the present invention weighted vest. It should also be noted that the weight packets utilized in the present invention weighted vest such as weight packet 98 are preferably formed of a pliable fabric material. Accordingly, the particulate nature of the weighted shot utilized within the weighted packet together with this fabric flexibility provides a weight packet which may be easily conformed to the underlying body portion of the user. This in turn enhances the form fitting character of weight distribution for the user. Additionally, the current invention may be worn under American football shoulder pads and uniforms during select practices. The pliable weight packets may also behave like a protective cushion or padding so the athlete is afforded compact effective protection from blows to the lower back and kidneys. As such, two weight packets such as weight packet 109 shown in FIG. 5 are secured to band 77 by attachment flap 118 while weight packet 98 is inserted in weight retaining bands 103, 104 and 105 and attached with attachment flap 99 to band 74. In this use, the weight packets as referenced eliminate the need for otherwise bulky lower back protective means, which are routinely worn.

FIG. 5 also shows an additional fabric attachment band 77 secured to the interior of vest 10 and extending across the rear surface thereof. Attachment band 77 allows one or more weight packets such as weight packet 109 to be secured within the interior of vest 10 to position weight packets in a protective location which protects the wearer's lower back. By way of example, weight packet 109 is shown attached to band 77 using attachment flap 118 upon band 77. Weight packet 109 and flap 118 are substantially identical to weight packet 98 and flap 99 (shown in FIG. 10).

Figure 5A:
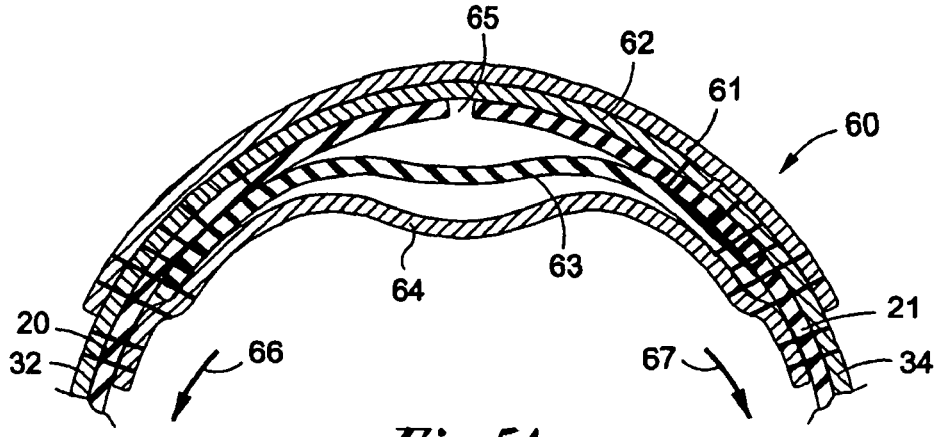
FIGS. 5A-5C set forth section views taken along section lines 5A-C through 5A-C in FIG. 5.
Figure 5B:
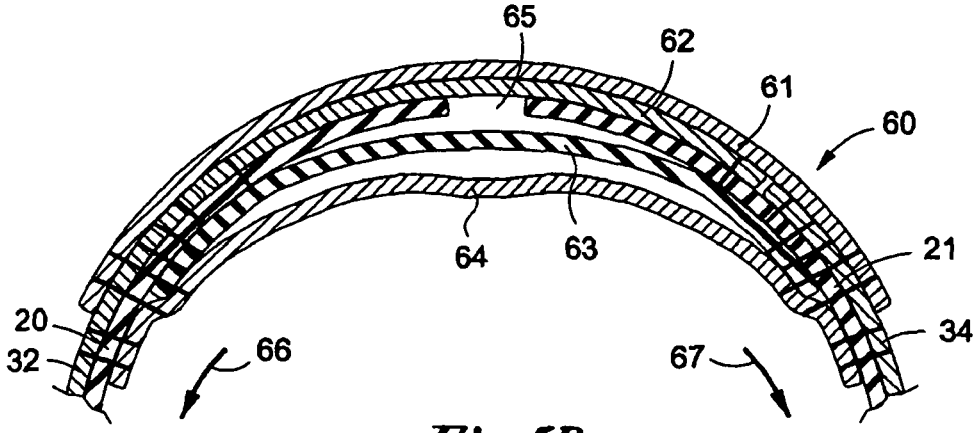
Figure 5C:
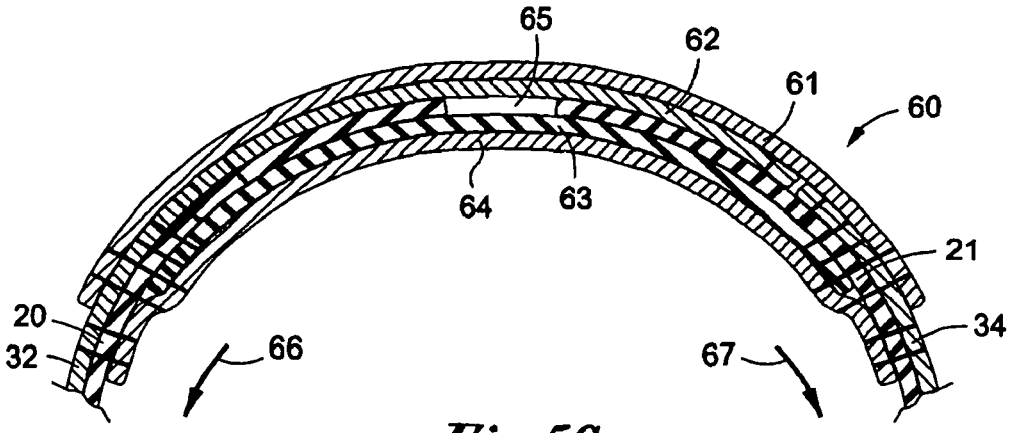

FIGS. 5A-5C set forth section views of expansion joint 60 taken along section lines 5A-C in FIG. 5. It will be noted that expansion joints 50 and 60 are substantially identical in fabrication. Accordingly, the descriptions of expansion joint 60 set forth in FIGS. 5A-5C will be understood to be equally descriptive and equally illustrative of expansion joint 50. Front panel 21 and back panel 20 extend upwardly from the front and back portions respectively of weighted vest 10. In accordance with the inventive expansion joint fabrication, front panel 21 and back panel 20 are not joined but rather form a gap 65 between the upper edges thereof. This gap facilitates the separation of front panel 21 from back panel 20 in response to stress imposed upon expansion joint 60 during athlete movement and acceleration. These stresses which for example are produced as the athlete wearing weight vest 10 accelerates out of a sprinters stance are created primarily by the inertial effect of the various weights supported within the vest. For purposes of illustration, these forces are shown acting upon expansion joint 60 in the directions indicated by arrows 66 and 67. As described above, front panel 21 includes a vertical support strap 34 joined thereto by sewing attachment. Similarly, and as is also described above, back panel 20 includes a vertical strap 32 secured thereto by conventional sewing attachment.

Expansion joint 60 includes an elastic band 61 joined to vertical strap 34 at one end and vertical strap 32 at the other end. Elastic band 61 extends across gap 65. Similarly, an elastic band 62 is joined to front panel 21 at one end and to back panel 20 at the opposite end. Elastic band 62 passes gap 65. An additional elastic band 63 is secured to front panel 21 at one end to back panel 20 at the opposite end. Elastic 63 passes over gap 65. Finally, an elastic band 64 is joined at one end to front panel 21 and is joined back panel 20 at the remaining end. Elastic band 64 passes over gap 65.

The resulting structure of expansion joint 60 provides a plurality of elastic bands extending between the upper portions of front panel 21 and back panel 20. In the preferred fabrication of the present invention, elastic bands 61 through 64 are provided with slightly different effective lengths to produce differing amounts of slack. In the example shown in FIG. 5A, expansion joint 60 is generally slack and elastic bands 61 and 62 are somewhat slack while elastic bands 63 and 64 are substantially slack. In further accordance with the preferred fabrication of the present invention, the spring constant or stretchability of each of elastic bands 61 through 64 is selected to provide the desired overall stretch characteristic for expansion joint 60.

In FIG. 5A with expansion joint 60 slack and an absence of force applied to the expansion joint, elastic bands 61 through 64 are generally slack. As stress is applied to expansion joint 60 in the directions indicated by arrows 66 and 67, elastic band 61 initially begins absorbing some of the expansion and becomes slightly stretched. Correspondingly, elastic band 62 is slightly stretched while elastic bands 63 and 64 remain slack.

FIG. 5B sets forth the configuration of expansion joint 60 in a partially stretched or partially expanded configuration. At the point shown in FIG. 5B, elastic bands 61 and 62 have begun stretching with elastic band 61 stretching more than elastic band 62. At this intermediate point, elastic bands 63 and 64 are still slack.

FIG. 5C sets forth the configuration of expansion joint 60 in a fully stretched configuration. As can be seen, elastic bands 61 and 62 are fully stretched while elastic bands 63 and 64 have begun stretching but maintain additional elasticity.

As the drawing force in the direction of arrows 66 and 67 is reduced, elastic bands 61 through 64 relax and expansion joint 60 returns to its normal configuration as seen in FIG. 5A.

In accordance with an important aspect of the present invention, the stretch characteristics of expansion joint 60 may be varied to suit the users needs by selecting the amount of slack for each of elastic bands 61 through 64 and may be further varied by selecting the relative elastic strengths or spring constant of each of the elastic bands. By setting the relative amounts of slack within the elastic bands, the point at which expansion joint 60 stretches a given band is determined. In addition to reducing stress imposed on the user's neck, shoulder and collarbone area, expansion joint 60 provides virtually unrestricted overhead arm movement. This freedom of movement is particularly advantageous when the present invention vest is worn during sports such as basketball. Expansion joint 60 also allows the shoulder joint to meet varied stresses without the need for padding which prior art devices usually require.

Figure 6:
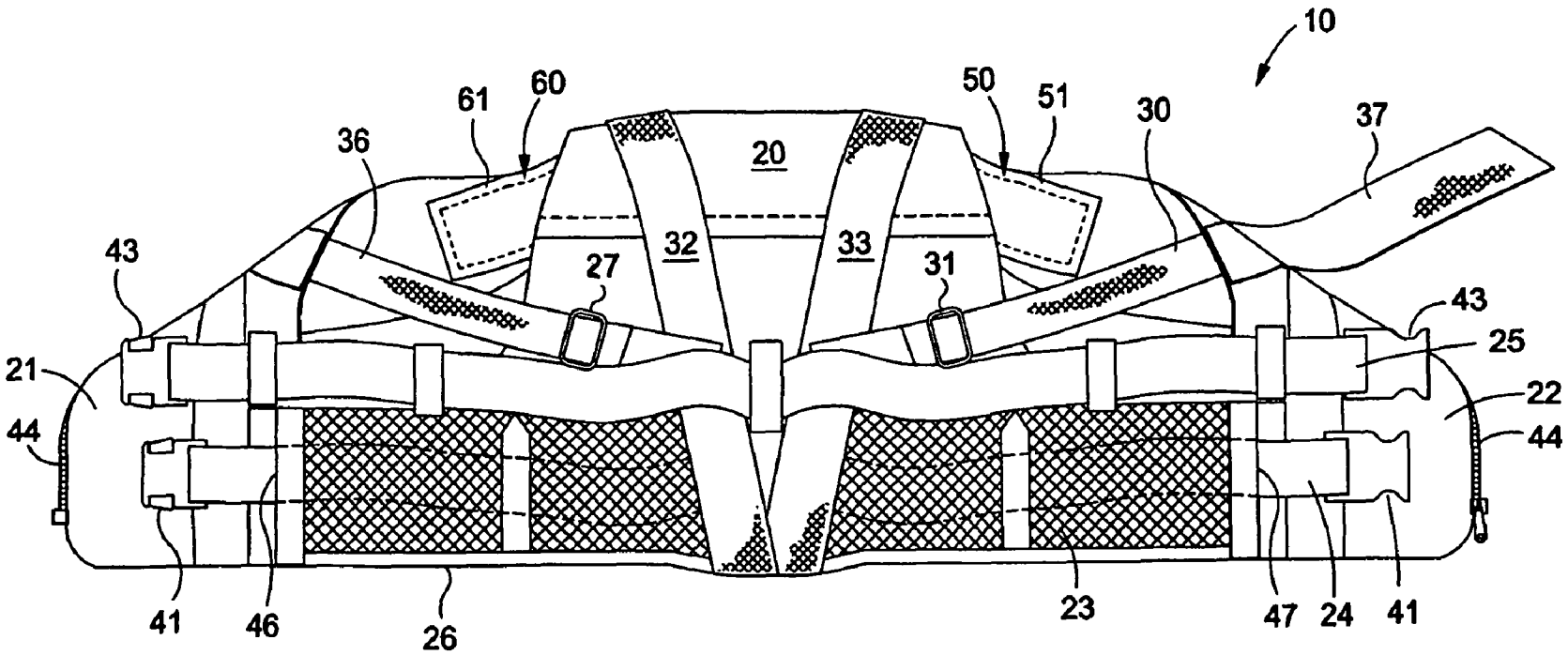
FIG. 6 sets forth a rear view of the present invention weighted athletic training vest in a flattened open configuration.

FIG. 6 sets forth a rear view of weight vest 10 in an open condition spread to a generally flat configuration. As described above, weighted vest 10 includes a back panel 20 to which a pair of front panels 21 and 22 are joined. A zipper 44 is provided to couple front panels 21 and 22 to secure weight vest 10 upon the user's body. As is also described above, weight vest 10 includes a pair of vertical support straps 32 and 33 which extend upwardly and outwardly from bottom edge 26 to diverge upon back panel 20. A pair of expansion joints 50 and 60 are coupled between back panel 20 and front panels 22 and 21 respectively. Vest 10 further includes a pair of side belts 30 and 36 secured using conventional buckles 31 and 27 respectively. Weighted vest further includes a belt 24 having a buckle fastener 41. Belt 24 passes through a slot 47 formed in front panel 22 to travel beneath mesh area 23 to emerge at a slot 46 formed in front panel 21. The extending portions of belt 24 which extend beyond slots 47 and 46 support the cooperating elements of buckle 41. A belt 25 is supported upon vest 10 by a plurality of conventional belt loops and includes a conventional buckle 43 for attachment.

In accordance with an important aspect of the present invention, and with simultaneous attention to FIGS. 5 and 6, it will be noted that mesh area 23 overlies a corresponding area of liner 70. In accordance with the preferred fabrication of the present invention, liner 70 is formed of a fabric which "breathes" and is relatively porous. Accordingly, the cooperation of the porous mesh areas provided by mesh 23 and the porosity of the underlying areas of liner 70 allow substantial air passage for the comfort of the user. In this manner, substantial heat is vented outwardly from the wearer's body.

Figure 7:
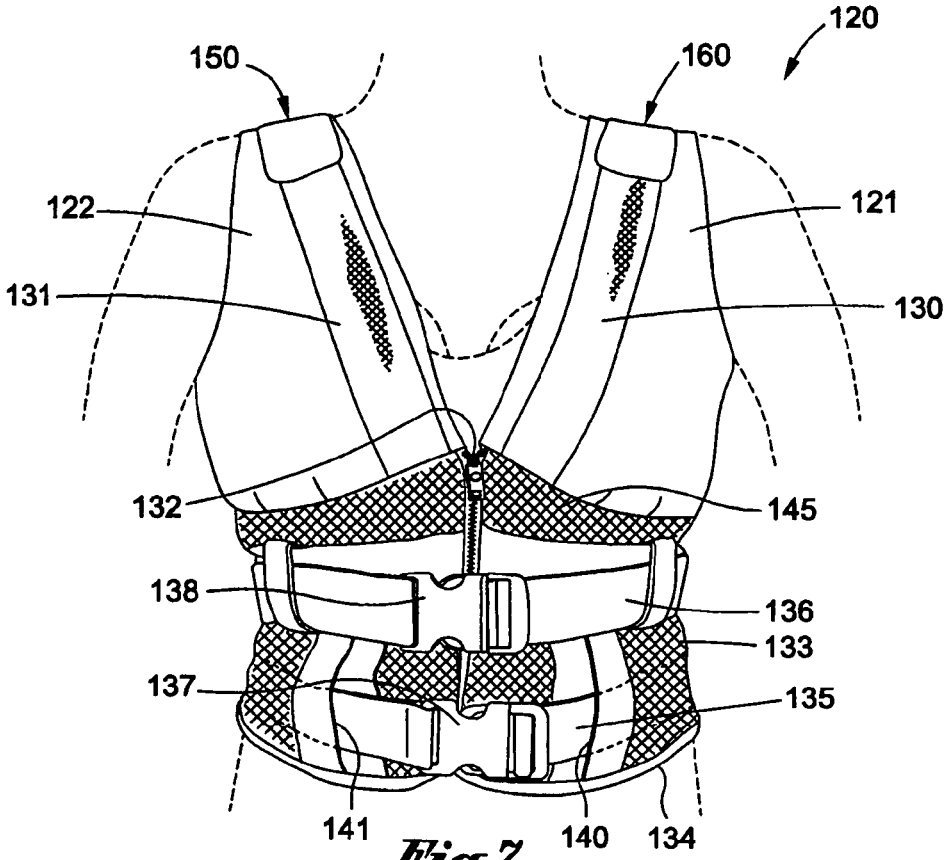
FIG. 7 sets forth a front view of an alternate embodiment of the present invention weighted athletic training vest designed for use by female athletes.
Figure 8:
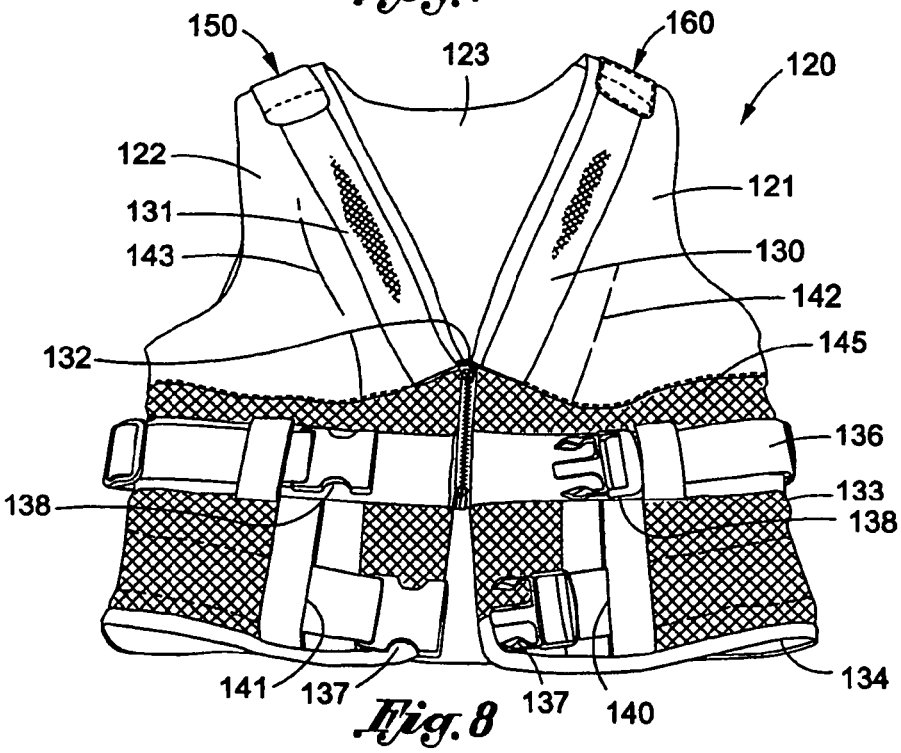
FIG. 8 sets forth a front view of the embodiment of FIG. 7 of the present invention weighted athletic training vests.

FIGS. 7 and 8 shown front views of an alternate embodiment of the present invention structured to better meet the needs of female users. FIG. 7 shows the embodiment of the present invention being worn by a typical female athlete shown in dash line representation. FIG. 8 shows the embodiment of FIG. 7 in a relaxed closed configuration with the belt buckles in the open configuration. By way of overview, comparison of FIGS. 7 and 8 to the above-described figures setting forth weighted vest 10 show the primary difference found in the presence of an additional band of mesh material above the abdomen belts and the absence of chest band 37. In most other respects however the fabrication of the embodiment in FIGS. 7 and 8 conforms generally to the advantageous structure of weighted vest 10 set forth above. Particularly, the distribution and securement of weight packets and the weight packets utilized therein are virtually identical in the embodiment shown in FIGS. 7 and 8 to weight vest 10 set forth above. Thus, for the most part, the descriptions set forth above in connection with weight vest 10 will be understood to apply equally well to the embodiment shown in FIGS. 7 and 8.

With specific reference to FIG. 7, an alternate embodiment of the present invention generally referenced by numeral 120 is shown being worn by a typical female athlete. Accordingly, weighted vest 120 is shown upon a dash line figure of a female athlete and is shown in its closed configuration. It will be understood that in accordance with the above-described structure of weighted vest 10, vest 120 supports a plurality of weight packets situated about the abdominal portion of the vest.

More specifically, weighted vest 120 is formed of a pair of mirror image front panels 121 and 122 joined at the frontal portions thereof by a conventional zipper 132. A pair of vertical support straps 130 and 131 extend upwardly upon vertical front panels 121 and 122 respectively and are joined to shoulder sections 150 and 160. Weighted vest 120 further includes a mesh area 133 generally encircling the lower abdomen of the weighted vest and having a pair of slots 140 and 141 formed therein. A belt 135 passes through slots 140 and 141 and continues beneath mesh 133 to encircle the lower portion of the weighted vest. Similarly, a belt 136 supported by conventional belt loops encircles the outside of weighted vest 120. Vest 120 further defines a bottom edge 134. A pair of belt buckles 137 and 138 provide joiner of the opposed ends of belts 135 and 136 respectively. An additional ventilating mesh area 145 encircles weighted vest 120 above belt 136 and is positioned to pass under the chest area of the wearer.

Shoulder portions 150 and 160 may be configured in substantial accord with expansion joints 50 and 60 shown above for weighted vest 10. Alternatively, in view of the anticipated lighter weights being carried by a female athlete, the use of expansion joints at shoulder elements 150 and 160 may be avoided and a simple shoulder junction may be provided. Comparing weighted vest 120 to weighted vest 10 described above, it will be noted that side belts 30 and 36 (seen in FIG. 3) as well as chest belt 37 (also seen in FIG. 3) have been omitted from vest 120. This is primarily to avoid introducing an uncomfortable tightness of the chest of the wearer.

FIG. 8 sets forth a front view of vest 120 in a relaxed configuration and separated from a wearer. For purposes of illustration, zipper 132 is shown closed to join the front panels.

More specifically, weighted vest 120 is formed of a back 123 and a pair of mirror image front panels 121 and 122 joined at the frontal portions thereof by a conventional zipper 132. A pair of vertical support straps 130 and 131 extends upwardly upon vertical front panels 121 and 122 respectively and is joined to shoulder sections 150 and 160. Panels 121 and 122 also define gussets 142 and 143 respectively which shape vest 120 to accommodate the female form. In particular, gussets 142 and 143 provide more comfort and support for a female's breasts and body shape. Weighted vest 120 further includes a mesh area 133 generally encircling the lower abdomen of the weighted vest and having a pair of slots 140 and 141 formed therein. A belt 135 passes through slots 140 and 141 and continues beneath mesh 133 to encircle the lower portion of the weighted vest. Similarly, a belt 136 supported by conventional belt loops encircles the outside of weighted vest 120. Vest 120 further defines a bottom edge 134. A pair of belt buckles 137 and 138 provide joiner of the opposed ends of belts 135 and 136 respectively. An additional ventilating mesh area 145 encircles weighted vest 120 above belt 136 and is positioned to pass under the chest area of the wearer.

Figure 9:
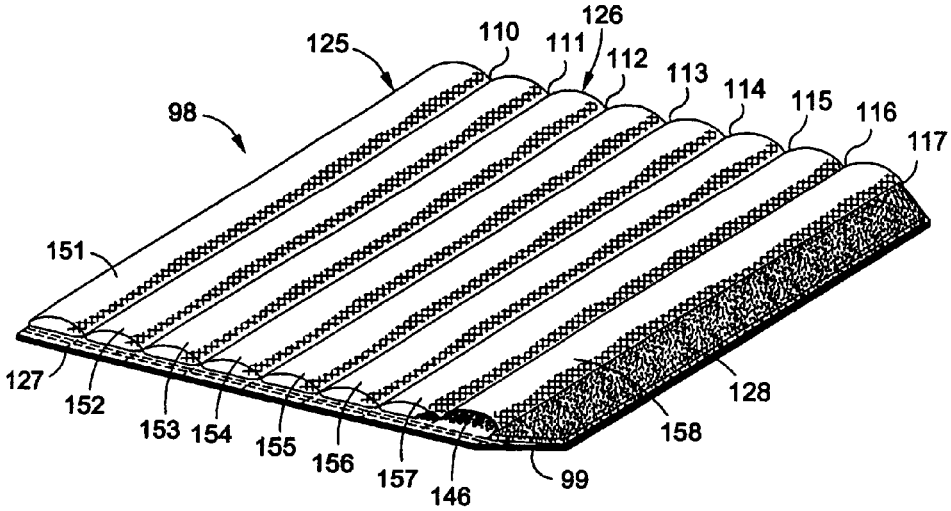
FIG. 9 sets forth a broken section perspective view of a pliable weight packet constructed in accordance with the present invention and utilized in the present invention weighted athletic training vest.

FIG. 9 sets forth a partially section perspective view of weight packet 98. As mentioned above, the present invention weighted vest utilizes a plurality of weight packets which are receivable within attachments situated throughout the abdomen area of the present invention weighted vest. As is also mentioned above, weight packet 98 is illustrative of the plurality of weight packets utilized in combination with the present invention weighted vest. More specifically, weight packet 98 is formed of a pliable fabric envelope 125 which defines a closed end 126 and a sewn edge 127. Fabric envelope 125 further defines a flat pliable attachment flap 99. A band of fabric attachment material is joined to attachment flap 99 to form an attachment pad 128. In the preferred fabrication of weight packet 98, a quantity of pliable fabric is folded to define closed end 126 and is joined along sewn edge 127 to provide closure. In further accordance with the preferred fabrication of the present invention, a plurality of sewn seams 110 through 117 are substantially evenly spaced in parallel arrangement to join the opposed layers of fabric envelope 125. This construction forms a plurality of hollow tubes 151 through 158 between sewn seams 110 through 117. In further accordance with the preferred fabrication of present invention, tubes 151 through 158 are filled with a particulate weight material such as fine lead shot or the like. The granular or particulate nature of the weight material filling tubes 151 through 158 together with the pliable character of fabric envelope 125 results in a weight packet which is pliable and easily conforms to the wearer when supported within the present invention weight vest.

Figure 10:
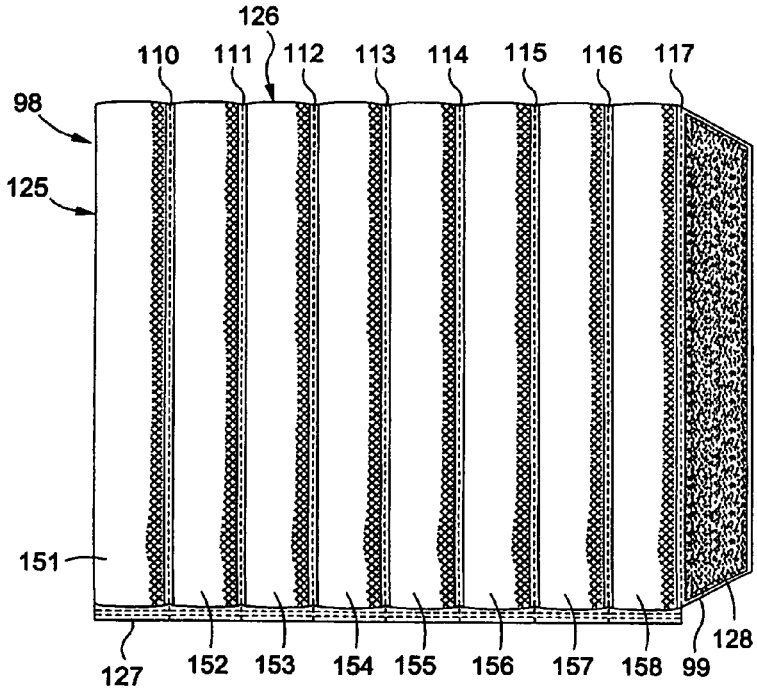
FIG. 10 sets forth a top view of the weight packet shown above in FIG. 9.

FIG. 10 sets forth a top plan view of weight packet 98 which, as described above, is formed of a fabric envelope 125 folded to form a closed end 126 and sewn to form a sewn edge 127. As is also described above, fabric envelope 125 further defines an attachment flap 99 upon which attachment pad 128 is secured. Finally, sewn seams 110 through 117 join portions of the opposed layers of fabric envelope 125 to define tubular cells 151 through 158 therebetween. In final construction, a quantity of particulate weight material 146 (seen in FIG. 9) is received and captivated within tubes 151 through 158.

Figure 11:
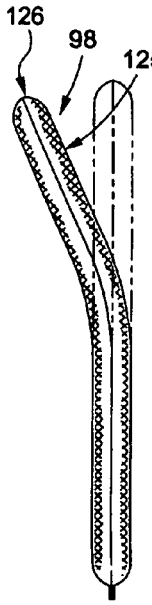
FIG. 11 sets forth a side elevation view of the weight packet shown in FIGS. 9 and 10 in an illustrative flexed configuration.

For purposes of illustration, FIG. 11 shows weight packet 98 being flexed or bent in accordance with the above-described fabrication. In addition, the pliable character of the inventive weight packets absorbs energy when impacted. This, in turn, allows the weight packets to provide a cushioning feature which is particularly advantageous in contact sports such as football. With this cushioning effect, the need for an interposed pad can be avoided. Also the pliability allows the user to avoid over-tightening of the body-encircling belts which would otherwise be required to keep the weights in place.

In accordance with an important aspect of the current invention it will be apparent to those skilled in the art that the construction of the weight packets such as weight packet 98 results in a thin and pliable weight packet having a soft surface area fully compatible to come in contact with the athlete and self conform and hug to the athletes torso. Therefore, the soft, pliable weight packet eliminates the need for padding as used in most prior art to cushion or protect the wearer from what is typically a hard metal weight. This cohesive arrangement of a soft, pliable body hugging weight packet substantially limits the amount of inertia that can be exerted on the weight packets 98 by a sprinting athlete or during rapid athletic change of direction and thereby, cooperatively assists to eliminate bouncing or swinging that would otherwise occur with padded metal weights or unpadded metal weights during sprint training or other aggressive athletic activity where maximum bouts of leg speed and upper body movement dominant.

Figure 12:
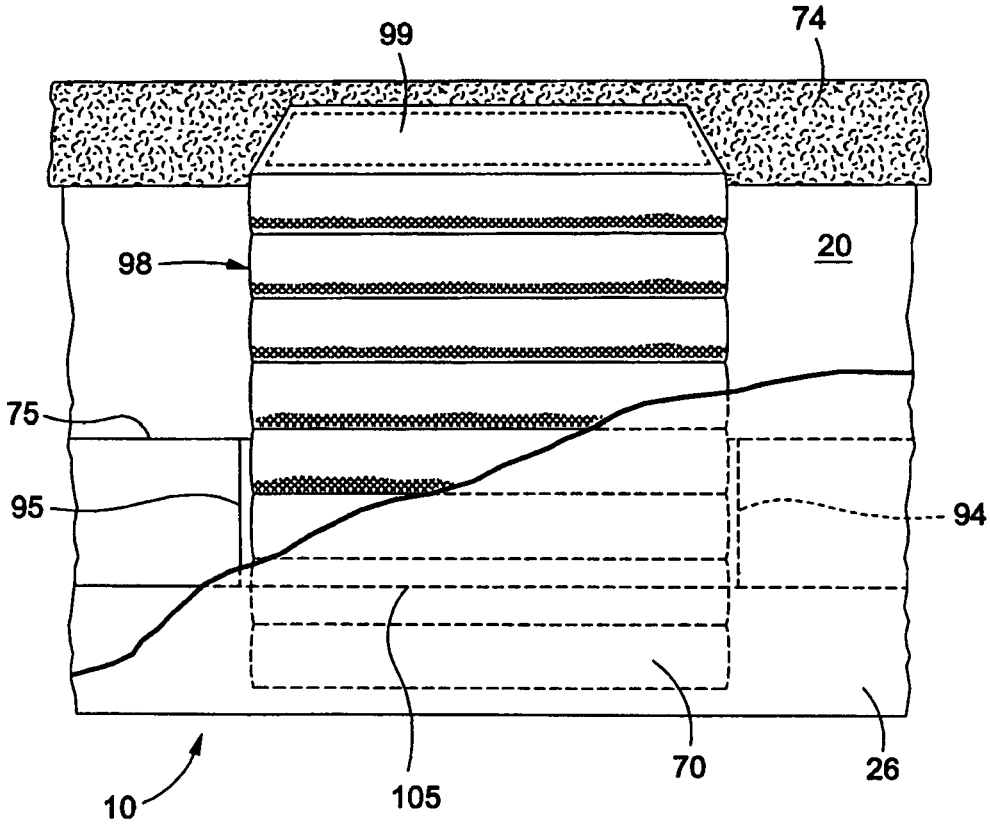
FIG. 12 sets forth an enlarged partially section view of a typical weight retaining pocket and cooperating weight packet within the present invention weighted athletic training vest.

FIG. 12 sets forth a partial section view of the present invention weighted vest showing a typical weight packet retention. It will be understood that the various weight packet attachment utilized in the present invention weighted vest such as shown above in FIG. 5 are carried forward with substantially the same illustrative structure shown in FIG. 12. More specifically, FIG. 12 sets forth a partial section view of a portion of the present invention weighted vest. It will be understood that while the illustration shown in FIG. 12 sets forth a weight packet attachment for vest 10, the weight packets are supported within vest 120 in the identical manner. Thus, a portion of weighted vest 10 is shown in the manner set forth above in FIG. 5 having weight packet 98 received and assembled therein. As mentioned above, weighted vest 10 includes a bottom edge 26, a back panel 20 and a liner 70. Within the space provided between back panel 20 and liner 70, a band of fabric attachment material 74 is secured to the inner surface of back panel 20. As is also mentioned above, a band of elastic material 75 is secured to the interior surface of liner 70 by a plurality of sewn seams including seams 94 and 95. The portion of elastic band 75 between seams 94 and 95 forms a resilient elastic weight-retaining band 105.

In accordance with the present invention, and with simultaneous reference to FIG. 5, slot 71 is opened utilizing zipper 81 and allowing access to the interior of weighted vest 10. Weight packet 98 is then inserted through the open slot into the interior of the weighted vest. The user then positions weight packet 99 within weight-retaining band 105 between seams 94 and 95 to secure the lower portion of weight packet 98. As a final attachment step, attachment flap 99 having attachment pad 128 (seen in FIG. 9) is secured to the cooperating hook and loop fabric attachment material of attachment band 74. This dual attachment secures weight packet 98 within the interior of weighted vest 10. Other weighted packets are inserted as desired throughout the weight band securing apparatus 10 in a similar fashion. This secure attachment is further enhanced by the action of belts 24 and 25 (seen in FIG. 3). It is important to emphasize that the pliable easily formed character of the present invention weight packets greatly increases the security of weight packet attachment and retention and enhances the comfort and effectiveness of the present invention weighted vest.

Figure 13:
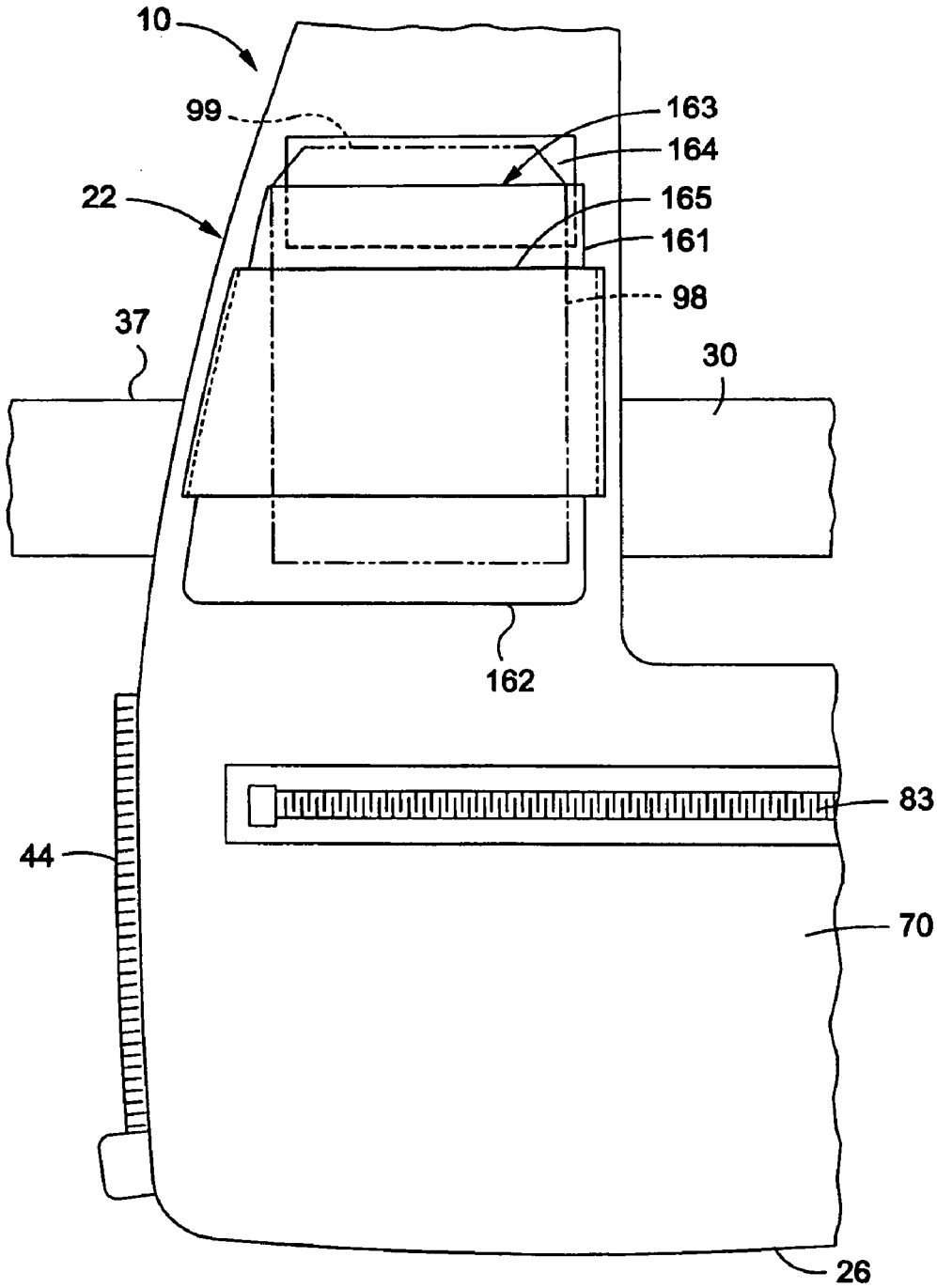
FIG. 13 sets forth a partial interior view of the front panel of the present invention weighted athletic training vest showing a loose article pocket supported therein.

FIG. 13 sets forth a partial interior view of front panel 22 of weighted vest 10. As described above, front panel 22 supports a liner 70 formed of a somewhat pervious breathable fabric together with a zipper 44 and a bottom edge 26. Front panel 22 further includes a zipper 83 which, as is set forth above in FIG. 5, provides access to a plurality of weight supporting apparatus within vest 10. A side belt 30 and a chest belt 37 are further secured to the frontal surface (seen in FIG. 5) of front panel 22.

In accordance with an important aspect of the present invention, weight vest 10 further includes a pocket 161 formed on the interior surface of lining 70. Pocket 161 defines a closed bottom end 162 and an open top end 163 to provide a secure pocket having an upwardly open mouth. A fabric attachment pad 164 is received behind the upper edge of pocket 161 and is secured to lining 70. Pocket 161 is provided to facilitate the wearer being able to carry various essential loose items such as key, money, credit cards and the like while engaging in athletic training activities. In further accordance with an important advantage of the present invention structure, an elastic sheath 165 is attached to the interior of vest 10 overlapping pocket 161 which, in cooperation with attachment pad 164, is utilized in securing a weight packet such as weight packet 98. Thus, for purposes of illustration, weight packet 98 is shown resting upon the outer surface of pocket 161 within elastic sheath 165 and is shown in phantom line depiction. In a similar fashion to the attachment of weight packet 98 described below in FIG. 12, flap 99 of weight packet 98 is positioned overlying a portion of fabric attachment pad 164 which allows attachment pad 128 (seen in FIG. 10) to secure flap 99 upon fabric attachment pad 164. In this manner, attachment of weight packet 98 upon the interior of front panel 22 together with closure of open top 163 of pocket 161 is simultaneously obtained. When the user closes front panel 22 upon their body, the combination of side belt 30 and chest belt 37 further secures weight packet 98 against the user's chest. The user is able to insert or remove the weight packet by simply reaching into the vest and need not open or undo the vest. Under workout conditions, this feature is extremely convenient.

In the preferred fabrication of the present invention, a corresponding structure is provided upon the interior of front panel 21. Accordingly, the descriptions of front panel 22 set forth in FIG. 13 will be understood to apply equally well and equally descriptive of the corresponding structure within the interior of front panel 21.

What has been shown is a novel weight athletic training vest which provides an enhanced degree of comfort and effectiveness while securing a plurality of weighted packets to the vest. The pliable easily formed structure of the weight packets allows the weight packets to readily conform to the contours of the athlete's body and thus improves the comfort and secure attachment of the weight packets. The present invention weighted vest is particularly suitable for activities such as sprint starts or football activities and exceeds the capabilities for performing under these conditions provided here-to-for by prior art devices. The inventive structure further provides a novel expansion joint arrangement for the load bearing portions of the vest passing over the user's shoulder, neck and collar bone body areas. The expansive joint provides a variable spring rate elastic energy and stress absorption apparatus. This apparatus is particularly active during moments of substantial acceleration when the inertia of weight within the vest comes into play and would otherwise increase the stress upon the athlete's body. The present invention vest further facilitates the secure carrying of loose items such as keys, coins, credit cards and the like. The inventive vest further facilitates the dissipation of body heat by utilizing a porous fabric liner together with an outer layer of extremely porous mesh material. In this manner, body heat is allowed to breathe and disperse outwardly from the vest interior. The inventive vest provides weight distribution upon the athlete's body which preserves the capability to maintain proper balance, mechanics and training techniques during sprint starting and other periods of acceleration. The vest is sufficiently secure and hardy in its maintenance of weight packet positions to endure more vigorous activities such as contact and impacts during sports which are inherently contact sports such as American football or the like.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A weighted athletic training vest comprising:

a back panel and a pair of generally mirror-image front panels joined to form an athletic vest having an abdomen-encircling vest portion, said athletic vest defining an interior configured to generally overlie the body of a wearer and defining a vertical direction and a horizontal direction;

a plurality of weight packet receptacles within said abdomen-encircling vest portion;

first hook and loop fabric attachment pad supported within said interior;

a plurality of weight packets each removably receivable within said weight packet receptacles and each having a pliable envelope defining a plurality of elongated compartments filled with a particulate weight material to form a pliable weight packet and each supporting a second hook and loop fabric attachment pad, said first and second fabric attachment pads cooperating to further secure said weight packets within said weight receptacles such that said elongated compartments of said weight packets are aligned with said horizontal direction and said weight packets are securely held and conform to the body of an athlete wearing said vest; and a pair of belts supported on said abdomen-encircling vest portion each having joinable buckles for drawing said belts tightly upon said abdomen-encircling vest portion to further secure said weight packets.

2. The weighted athletic training vest set forth in claim 1 further including a porous fabric liner supported within said vest and being generally coextensive with said front and back panels and wherein said weight packet receptacles are supported within said porous fabric liner, said porous fabric liner becoming moist by absorbing a user's perspiration and tending to further fix said weight packets.

3. The weighted athletic training vest set forth in claim 2 wherein said porous fabric liner includes a plurality of slots each having zipper closures for providing access to said weight packet receptacles.

4. The weighted athletic training vest set forth in claim 3 wherein said weight packet receptacles include an elongated elastic band joined to said porous fabric liner at spaced intervals to form elastic packet-retaining bands.

5. The weighted athletic training vest set forth in claim 4 wherein each of said weight packets include an attachment flap having said second hook and loop fabric attachment pad thereon and wherein said first hook and loop fabric attachment material includes an elongated ribbon of cooperating hook and loop fabric attachment material secured to said front and back panels, said second hook and loop attachment pads joined to said elongated ribbon to further secure said weight packets within said weight packet receptacles.

6. The weighted athletic training vest set forth in claim 5 wherein said front panels define edges and wherein said edges include a cooperating zipper for joining said edges to close said vest upon a wearer.

7. The weighted athletic training vest set forth in claim 6 wherein each of said front panels defines an interior surface having an open top pocket having an open top for supporting loose items to be carried by wearer.

8. The weighted athletic training vest set forth in claim 7 wherein each of said open top pockets include a hook and loop fabric attachment pad proximate said open top for attaching a weight packet upon said open top pocket.

9. The weighted athletic training vest set forth in claim 1 wherein each of said belts in said pair of belts is formed of a three piece fabrication which includes said buckle, a non-stretch portion and a stretchable portion.

10. A weighted athletic training vest comprising:

a back panel having a back panel abdomen portion and spaced back panel shoulder portions, said back panel shoulder portions extending upwardly over a wearer's shoulders;

a pair of generally mirror-image front panels each having a front panel abdomen portion joined to said back panel abdomen portion and each having a front panel shoulder portion, said front panel shoulder portions extending upwardly over a wearer's shoulders toward said back panel shoulder portions forming a gap therebetween;

means for joining said front panels to close said vest upon a wearer;

a plurality of weight packet receptacles formed in said abdomen portions; and a pair of expansion joints coupled between each of said front panel shoulder portions and one of said back panel shoulder portions, said pair of expansion joints located generally upon the shoulder-neck-collarbone area of a wearer and crossing said gap, said pair of expansion joints each including, a plurality of elastic bands each having one end attached to said back panel shoulder portion and a remaining end joined to said front panel shoulder portion thereby bridging said gap, said plurality of elastic bands being attached to said back and front panel shoulder portions at different points to cause said elastic bands to define slightly different effective lengths to produce differing amounts of slack.

11. The weighted athletic training vest set forth in claim 10 wherein each of said elastic bands define a spring constant and wherein some of said spring constants differ from each other.

12. The weighted athletic training vest set forth in claim 11 wherein one or more of said elastic bands define greater effective lengths to maintain a loose tension-free slack condition under moderate joint stress.

13. The weighed athletic training vest set forth in claim 12 wherein said expansion joints each include at least three elastic bands each defining a different spring constant.

14. The weighted athletic training vest set forth in claim 11 further including a porous fabric liner supported within said vest and being generally coextensive with said front and back panels and wherein said weight packet receptacles are supported within said porous fabric liner.

15. The weighted athletic training vest set forth in claim 14 wherein said porous fabric liner includes a plurality of slots each having zipper closures for providing access to said weight packet receptacles and wherein said front panels each include a vertical reinforcing strap extending upwardly to said expansion joints.

16. The weighted athletic training vest set forth in claim 15 wherein said weight packet receptacles include an elongated elastic band joined to said porous fabric liner at spaced intervals to form elastic packet-retaining bands.

17. The weighted athletic training vest set forth in claim 16 wherein each of said weight packets include an attachment flap having a first hook and loop fabric attachment pad thereon and wherein said weight packet receptacles further includes an elongated ribbon of cooperating hook and loop fabric attachment material secured to said front and back panels, said first hook and loop attachment pads join to said elongated ribbon to further secure said weight packets within said weight packet receptacles.

18. The weighted athletic training vest set forth in claim 10 wherein each of said front panels defines an interior surface having an open top pocket for supporting loose items to be carried by wearer.

19. The weighted athletic training vest set forth in claim 18 wherein each of said open top pockets include a hook and loop fabric attachment pad proximate said open top for attaching a weight packet upon said open top pocket.

20. A weighted athlete training vest comprising:

a back panel and a pair of generally mirror-image front panels joined to form an athletic vest having an abdomen-encircling vest portion;

a porous fabric liner supported within said vest and being generally coextensive with said front and back panels and having a plurality of slots each having zipper closures;

a plurality of weight packet receptacles including an elongated elastic band joined to said porous fabric liner at spaced intervals to form elastic packet-retaining bands within said abdomen-encircling vest portion, said plurality of slots providing access to said weight packet receptacles;

a plurality of weight packets each removably receivable within said weight packet receptacles and each having a pliable envelope defining a plurality of compartments filled with a particulate weight material to form a pliable weight packet easily conformed to the body of an athlete wearing said vest; and a pair of belts supported on said abdomen-encircling vest portion each having joinable buckles for drawing said belts tightly upon said abdomen-encircling vest portion to further secure said weight packets, each of said weight packets including an attachment flap having a first hook and loop fabric attachment pad thereon and said weight packet receptacles further including an elongated ribbon of cooperating hook and loop fabric attachment material secured to said front and back panels, said first hook and loop attachment pads join to said elongated ribbon to further secure said weight packets within said weight packet receptacles.

* * * * *